US006296541B1

(12) United States Patent
Bezalel et al.

(10) Patent No.: US 6,296,541 B1
(45) Date of Patent: Oct. 2, 2001

(54) TOY CAPSULE

(75) Inventors: David Bezalel, Hewlett, NY (US); Andreas Wambach, Frankfurt am Main (DE)

(73) Assignee: Alottafun, Inc., West Bend, WI (US)

( * ) Notice: Subject to any disclaimer, the term of this patent is extended or adjusted under 35 U.S.C. 154(b) by 0 days.

(21) Appl. No.: 09/526,299

(22) Filed: Mar. 15, 2000

(51) Int. Cl.[7] ..... A63H 33/08; A63H 33/06; A47G 19/00; B65D 21/00

(52) U.S. Cl. ..... 446/105; 446/120; 446/125; 206/504; 215/10; 220/23.4; 220/23.6

(58) Field of Search ..... 446/102, 105, 446/121, 120, 124, 125; 206/45.2, 216, 504; 220/23.4, 23.6, 23.86; 275/10

(56) References Cited

U.S. PATENT DOCUMENTS

| | | | | |
|---|---|---|---|---|
| 4,103,774 | | 8/1978 | Shingyouchi . | |
| 4,106,657 | | 8/1978 | Dogliotti . | |
| 4,764,143 | | 8/1988 | Gat et al. . | |
| 5,035,324 | | 7/1991 | Bertrand . | |
| 5,402,903 | | 4/1995 | Mann . | |
| 5,853,314 | * | 12/1998 | Bora | 446/120 |
| 6,086,444 | * | 7/2000 | Glickman | 446/124 |

FOREIGN PATENT DOCUMENTS

G 86 22 192.2 11/1986 (DE) .

* cited by examiner

*Primary Examiner*—D. Neal Muir
(74) *Attorney, Agent, or Firm*—Dennis G. LaPointe; Mason & Associates, PA

(57) ABSTRACT

A toy capsule for containing toys and for constructing structures has an upper portion and a lower portion with wherein the upper and lower portions are detachably connected at their respective open ends thereby defining a closed container when the open ends are connected. A tapered thickened wall portion on each of the upper and lower portions extends concentrically from an intermediate location of an external surface of each of the cylindrical wall portions of the upper and lower portions and tapers to a thicker portion at the respective closed ends. One of the upper and lower portion closed ends has a rounded projection and the remaining upper and lower closed end has a projecting ridge defining a recess capable of receiving the rounded projection to form a releasable frictional tight fit connection. Multiple toy capsules are capable of interconnecting with each other with connections arranged around the perimeter of each of the upper and lower portions thereby allowing a child to form three dimensional structures.

17 Claims, 6 Drawing Sheets

TOY CAPSULE

BACKGROUND OF THE INVENTION

1. Field of the Invention

The invention relates to toy capsules which can be used to contain figurine toys or related toy objects and can also be used to construct or erect honeycomb-shaped structures.

2. Description of Related Art

Such containers are known in the art. However, most are relatively delicate plastic small containers for use inside other objects such as chocolate eggs. After removal from the egg, the toys are usable for erecting objects but their durability is limited due to their original intended use inside chocolate eggs. Such known related art includes U.S. Pat. Nos. 5,402,903 to Mann and 4,106,657 to Dogliotti. These prior art containers are also limited in the size and weight of toys due to their original intended use in chocolate eggs, and as such, the patents specifically disclose containers for small gifts.

However, known related art not used for insertion in chocolate eggs includes a capsule depicted in U.S. Pat. No. 4,103,774 to Shingyouchi, a toy packaging assembly depicted in U.S. Pat. No. 5,035,324 to Bertrand, and a toy assembly depicted in U.S. Pat. No. 4,764,143 to Gat et al.

An object of the present invention is to provide a durable reusable capsule which can contain a line of collectible figurine toys and related accessories. The capsules, for example, can be used to build a space station and figurines of space travelers and vehicles can be inserted in each capsule. A child's imagination in constructing or erecting three dimensional or honeycomb-shaped structures is virtually unlimited due to the many faceted interconnecting possibilities presented in the present invention.

SUMMARY OF THE INVENTION

The present invention is a toy capsule for containing toys and for constructing structures comprising a generally hollow container which includes an upper portion and a lower portion. The upper portion has an open end, a closed end and a cylindrical wall portion while the lower portion has an open end, a closed end and a cylindrical wall portion.

The upper and lower portions have means for detachably connecting their respective open ends thereby defining a closed container when the open ends are connected.

The toy capsule includes a tapered thickened wall portion on each of the upper and lower portions. The tapered thickened wall portion extends concentrically from an intermediate location of an external surface of each of the cylindrical wall portions of the upper and lower portions and tapers to a thicker portion at the closed end of each of the upper and lower portions.

One of the upper and lower portion closed ends has a rounded projection and one of the remaining upper and lower closed ends has a projecting ridge defining a recess capable of receiving the rounded projection to form a releasable frictional tight fit connection.

The toy capsule has connecting means on the external cylindrical wall surface of each of the upper and lower portions for connecting the toy capsule to one of an upper and lower portion, and of a combination thereof, of another toy capsule. The connecting means includes a plurality of longitudinal cylinders fixed to an inside surface of corresponding arcuate-shaped longitudinal portions and are spaced apart at a predetermined angle along a periphery of each of the upper and lower portions. The inside surface of each arcuate-shaped longitudinal portion commences at a predetermined depth within the cylindrical wall of each of the upper and lower portions or commences substantially tangent to the perimeter of the non-tapered external cylindrical wall surface. The arcuate-shaped longitudinal portions further extend outwardly a predetermined distance beyond the non-tapered external surface of the cylindrical wall so as to form a vertical longitudinal peak at opposing ends of the arcuate-shaped longitudinal portion, wherein each vertical peak merges with a perimeter of the closed end of each of the respective upper and lower portions. The arcuate-shaped longitudinal portions have a radial arc greater in diameter than a diameter of the longitudinal cylinders so as to allow a clearance between the longitudinal cylinder and each peak.

The connecting means further includes a plurality of coupler means. The coupler means are spaced-apart a predetermined angle along the periphery of each of the upper and lower portions. Each coupler means further comprising a substantially C-shaped longitudinal portion, wherein an inside surface of the C-shaped longitudinal portion commences at a predetermined depth within the cylindrical wall of each of the upper and lower portions or commences substantially tangent to the perimeter of the non-tapered external cylindrical wall surface, and extends outwardly a predetermined distance beyond the non-tapered external surface of the cylindrical wall so as to form a vertical longitudinal peak at opposing ends of the C-shaped longitudinal portion, wherein each vertical peak extends a predetermined distance beyond the perimeter of the closed end of each of the upper and lower portions.

Each coupler means is capable of detachably engaging with a friction tight fit a corresponding longitudinal cylinder on another toy capsule. The vertical peaks of the C-shaped longitudinal portion are adapted to extend into the clearances between the longitudinal cylinder and the arcuate-shaped vertical peaks, thereby facilitating the fairly tight frictional fit.

Each of the plurality of longitudinal cylinders sequentially alternate along the periphery of each of the upper and lower portions with each of the plurality of coupler means.

In a practical application of the means for detachably connecting the respective open ends of the upper and lower portions, a lap joint is formed which comprises a rim portion which extends a predetermined width from one of the open ends. The rim portion has a circumferential bead at an intermediate location around an outside surface of the rim portion. The lap joint also includes a recess on an interior surface of the remaining open end, the recess being located circumferentially a predetermined distance from an edge of the remaining open end. The recess is adapted to receive the bead for interlocking the upper and lower portions together.

Although the closed ends may have flat ends, it is preferable that the external surface of the closed end of each of the upper and lower portions be domed-shaped or slightly curved.

In a practical application of the rounded projection on one of the upper and lower portion closed ends, it is preferable to include a concave portion at a center of said rounded projection. This will facilitate a better fit for the rounded projection into the recess area should there be any imperfections or extrusions present from the manufacture of the toy capsule. It also allows an air pocket area for air expansion as the two portions are joined.

It is also preferable that at least one of the longitudinal cylinders be hollow. Practically, all of the longitudinal cylinders will be hollow throughout for ease of manufacture thereby alleviating the needed to stock both solid and hollow cylinders. The hollow cylinders will enable a string, wire or chain or similar attachment to pass through the hole for ease of carrying, displaying, hanging, etc.

Although any angular position may be used, in a practical application of the invention, it is preferable that each of the plurality of longitudinal cylinders be spaced-apart at about 90° from each other, and each of the plurality of coupler means be spaced-apart at about 90° from each other. This resulting configuration will allow each of the plurality of longitudinal cylinders to be spaced-apart from each of the plurality of coupler means at about 45° from each other.

The benefit for these connections along the perimeter of the cylinder walls of the upper and lower portions as well as the connections at the closed ends of the upper and lower portions is that the toy capsule can be interconnected with similarly designed toy capsules to form three-dimensional structures.

The toy capsule is preferably made from a durable and resilient plastic material. This type of material will allow a child to frequently handle the toy capsules, including frequently connecting and disconnecting the various portions or repetitively inserting and removing toy figurines and other toys from within the toy capsule.

The invention is adapted to be sold with a surprise toy contained within the capsule. Preferably collectible toys can be inserted such as space figurines and space vehicles. A child can then create three dimensional space stations using various separated and joined parts of the toy capsules as well as the figurines and associated toys. Of course, the theme is not limited to space travel, as almost any theme can be created using the toy capsule as a starting point.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
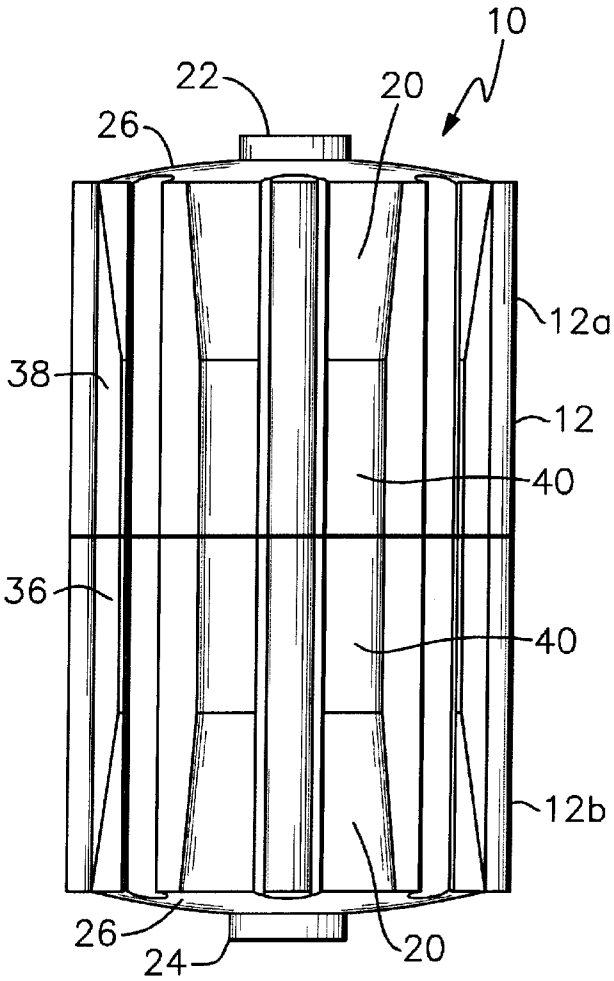
FIG. 1 is an elevational view of the present invention.
Figure 5:
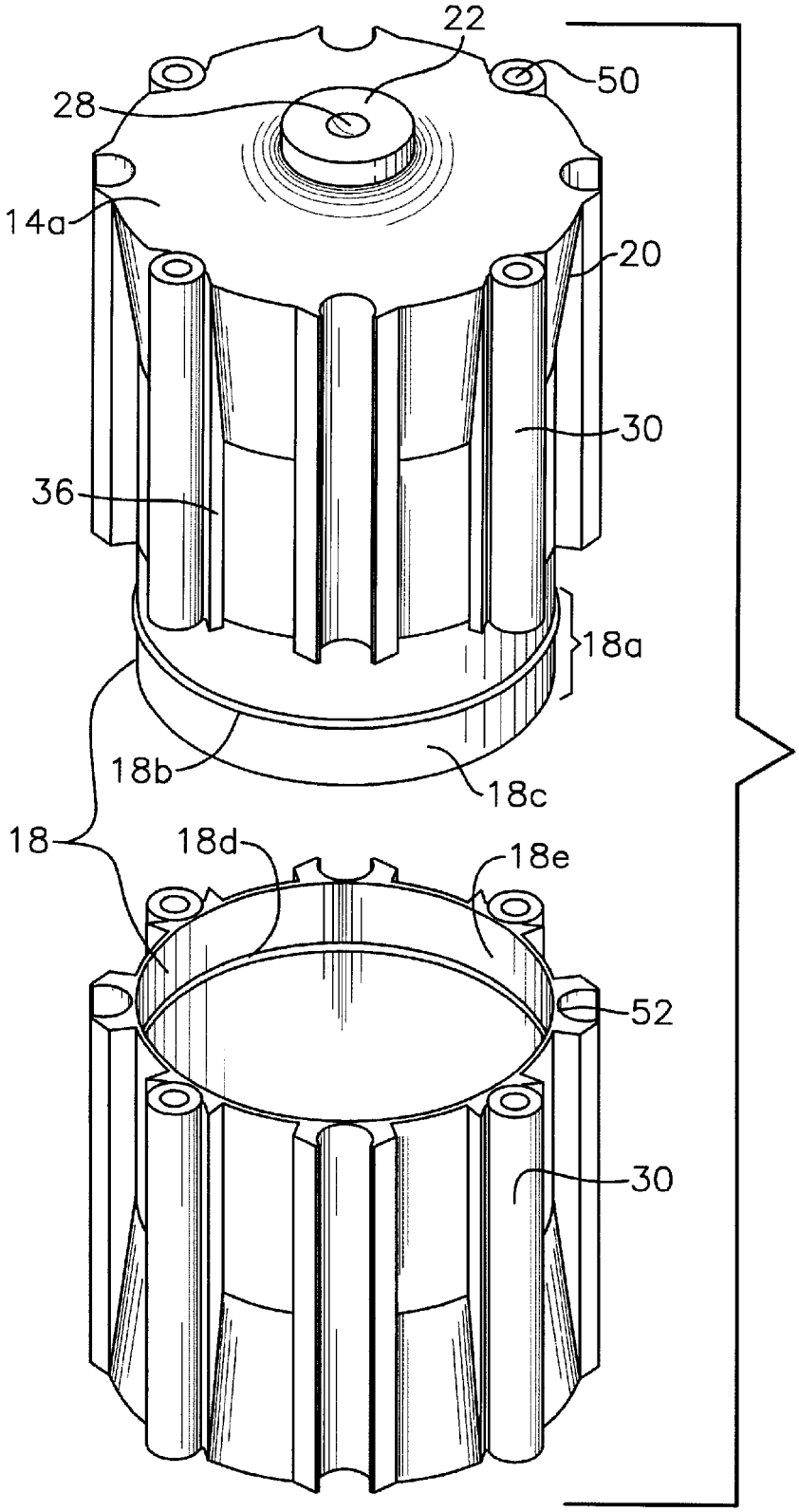
FIG. 5 is a perspective elevation view of the depiction of FIG. 4.
Figure 6:
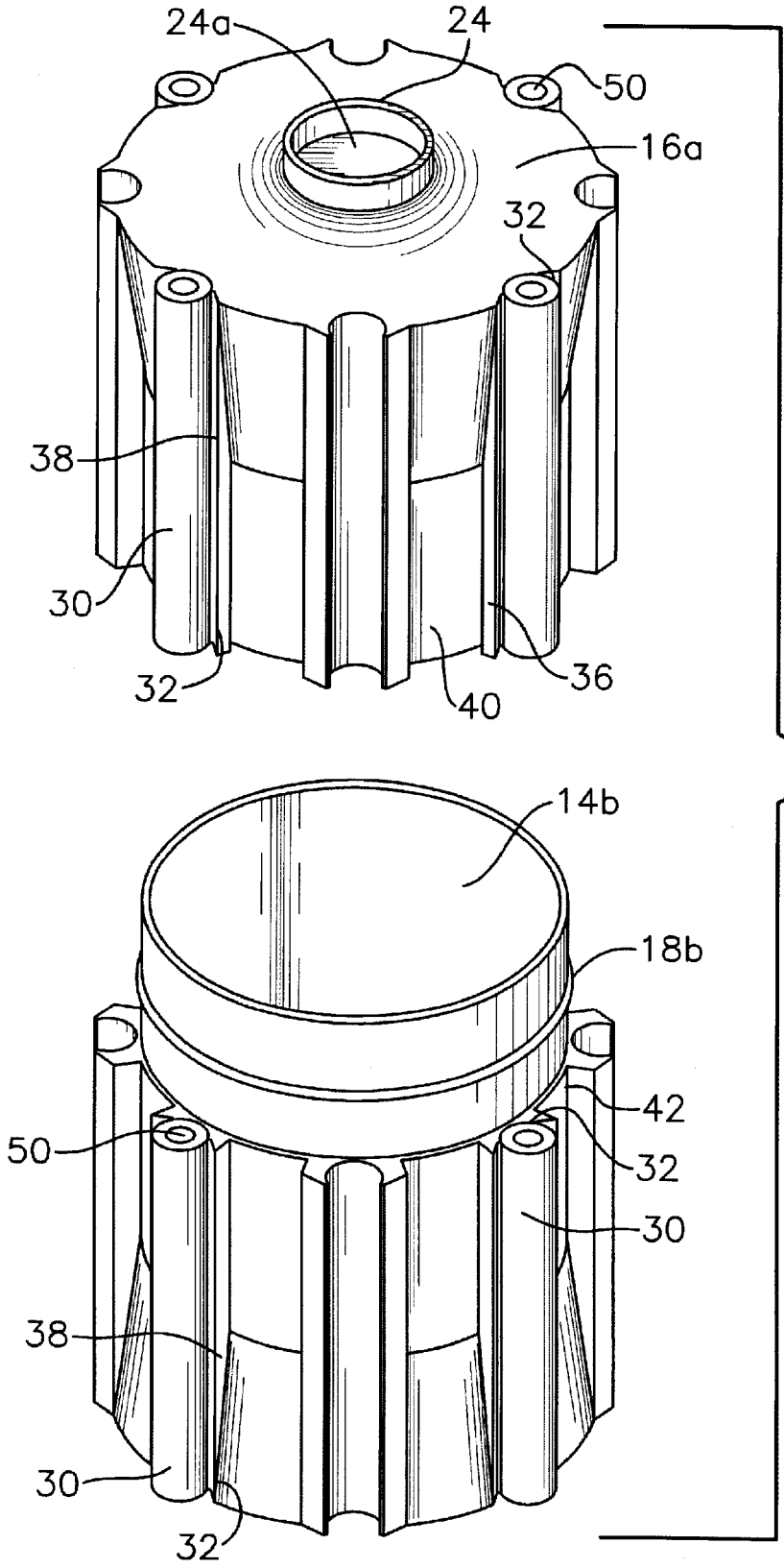
FIG. 6 is a perspective elevational view of the present invention as depicted in FIG. 4 with the present invention rotated from top to bottom 180°.
Figure 7:
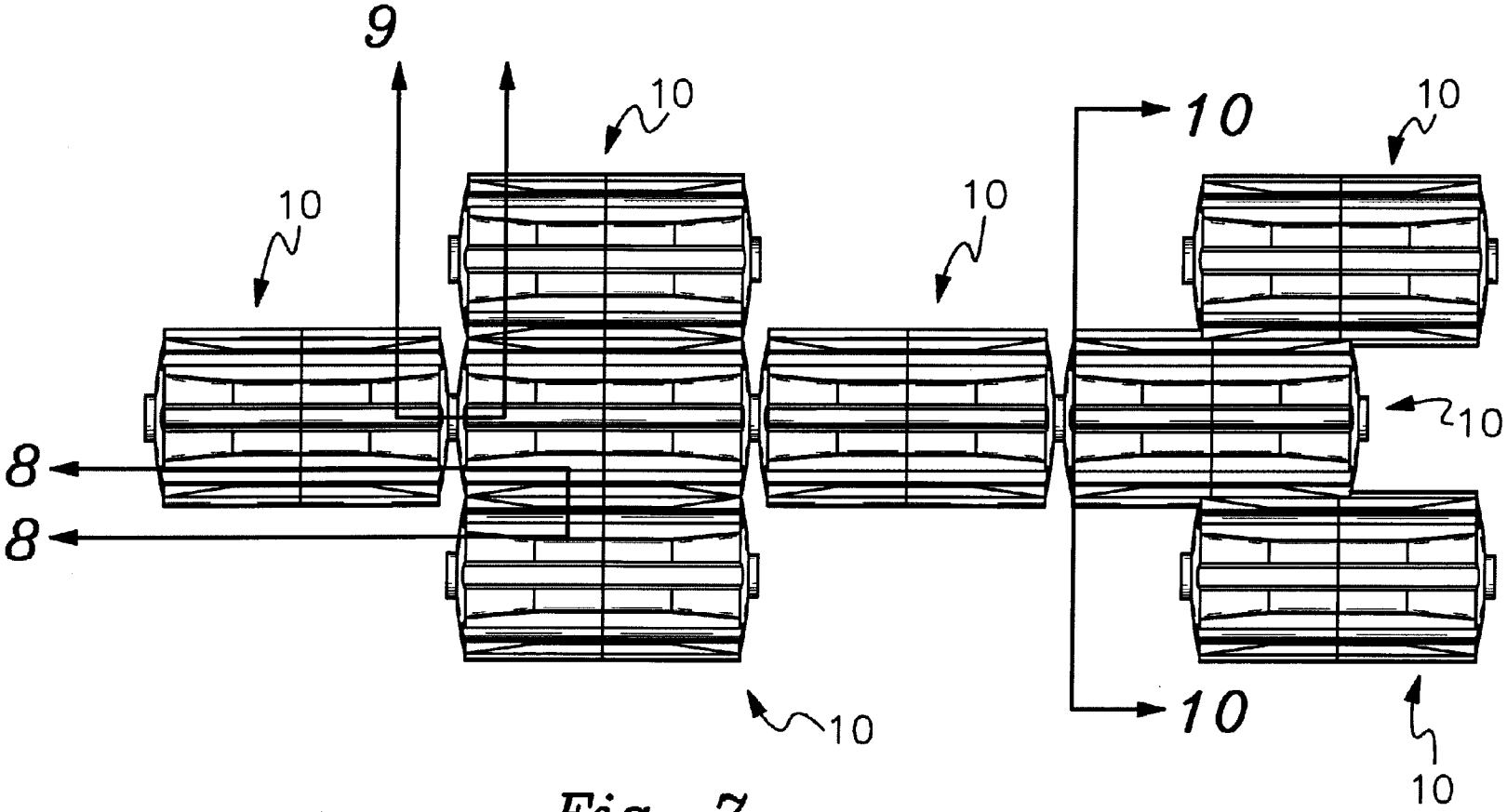
FIG. 7 is a view of several toy capsules forming a structure.
Figure 8:
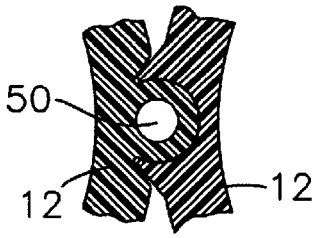
FIG. 8 is a cross-section view of the connection at the cylindrical walls of two toy capsules joined taken from view 8—8 of FIG. 7.
Figure 9:
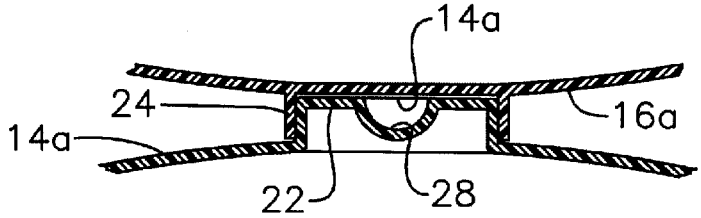
FIG. 9 is a cross-sectional view of the end to end connection for adjoining toy capsules taken from view 9—9 of FIG. 7.
Figure 10:
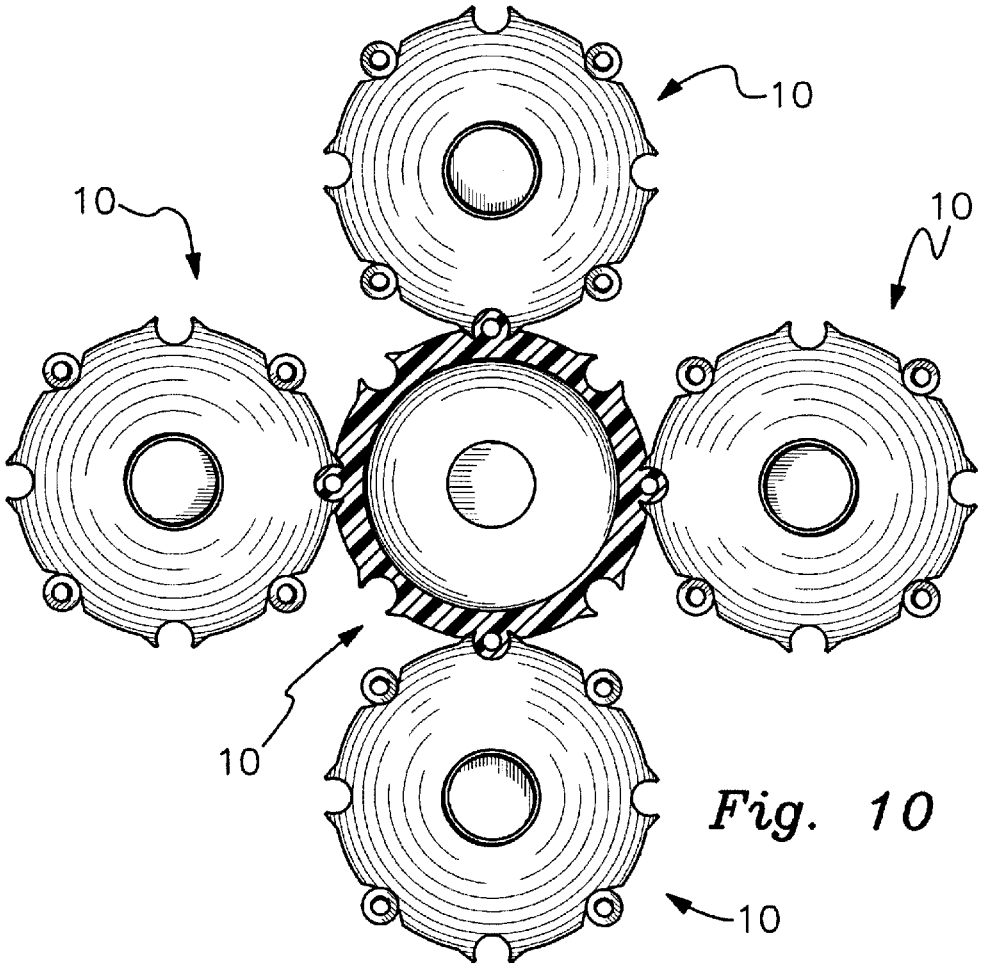
FIG. 10 is a cross-sectional view taken from view 10—10 of FIG. 7.

Referring now to the drawings, in particular FIGS. 1, 5 and 6, the invention which is a toy capsule depicted generally as 10, for containing toys and for constructing structures comprises a generally hollow container 12 which includes an upper portion 12*a* and a lower portion 12*b*. The upper portion 12*a* has an open end 14*b*, a closed end 14*a* and a cylindrical wall portion 42, while the lower portion 12*b* has an open end 16*b*, a closed end 16*a* and a cylindrical wall portion 42. Although it is preferable that the wall portion 42 be cylindrically shaped, it is within the scope of this invention that other shaped be used such as triangular, polygonal and other similar configurations.

The upper and lower portions 12*a*, 12*b* have means for detachably connecting their respective open ends 14*b*, 16*b*, thereby defining a closed container when the open ends 14*b*, 16*b* are connected.

The toy capsule 10 includes a tapered thickened wall portion 20 on each of the upper and lower portions 12*a*, 12*b*. The tapered thickened wall portion 20 extends concentrically from an intermediate location of an external surface 40 of each of the cylindrical wall portions 42 of the upper and lower portions 12*a*, 12*b* and tapers to a thicker portion at the closed end 14*a*,16*a* of each of the upper and lower portions 12*a*, 12*b*. The tapered thickened wall portion 20 is intermittent between connecting means on the external surface 40 of each of thee cylindrical wall portions 42, which is described hereinafter.

One of the upper and lower portion closed ends 14*a*, 16*a* has a rounded projection 22 and one of the remaining upper and lower closed ends 14*a*, 16*a* has a projecting ridge 24 defining a recess 24*a* capable of receiving the rounded projection 22 to form a releasable frictional tight fit connection. It does not matter which half of the toy capsule 10 has the rounded projection 22 or the projecting ridge 24. It is a matter of design choice at the preference of the manufacturer as long as toy capsules 10 are capable of being connected end to end. Other end to end interconnecting means are possible and within the scope of the invention; however, the rounded projection 22 with opposing projecting ridge 24 are believed to be cost effective and efficient connecting means to incorporate into the manufacturing process.

The toy capsule 10 has connecting means on the external cylindrical wall surface 40 of each of the upper and lower portions 12*a*, 12*b* for connecting the toy capsule 10 to one of an upper and lower portion 12*a*, 12*b*, and of a combination thereof, of another toy capsule 10. With the end to end connection possibilities described above, various three dimensional structures can be constructed or erected as shown in FIGS. 7–10.

Figure 2:
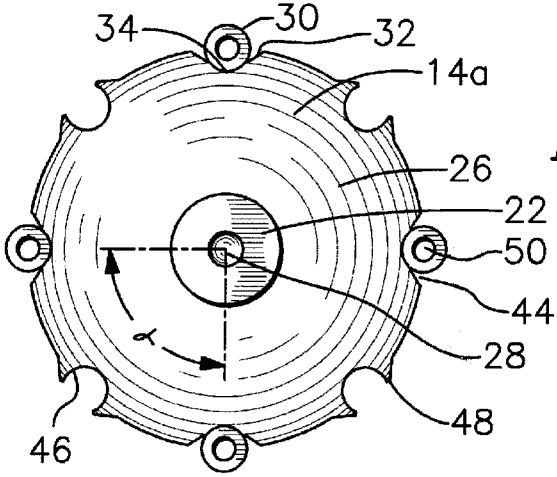
FIG. 2 is a plan view of the present invention.
Figure 3:
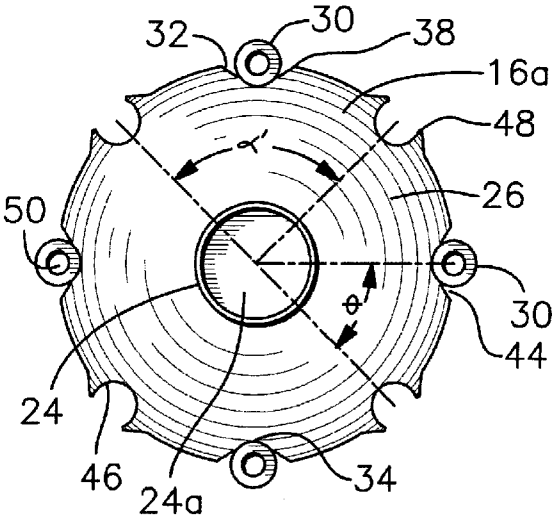
FIG. 3 is a bottom view of the present invention
Figure 4:
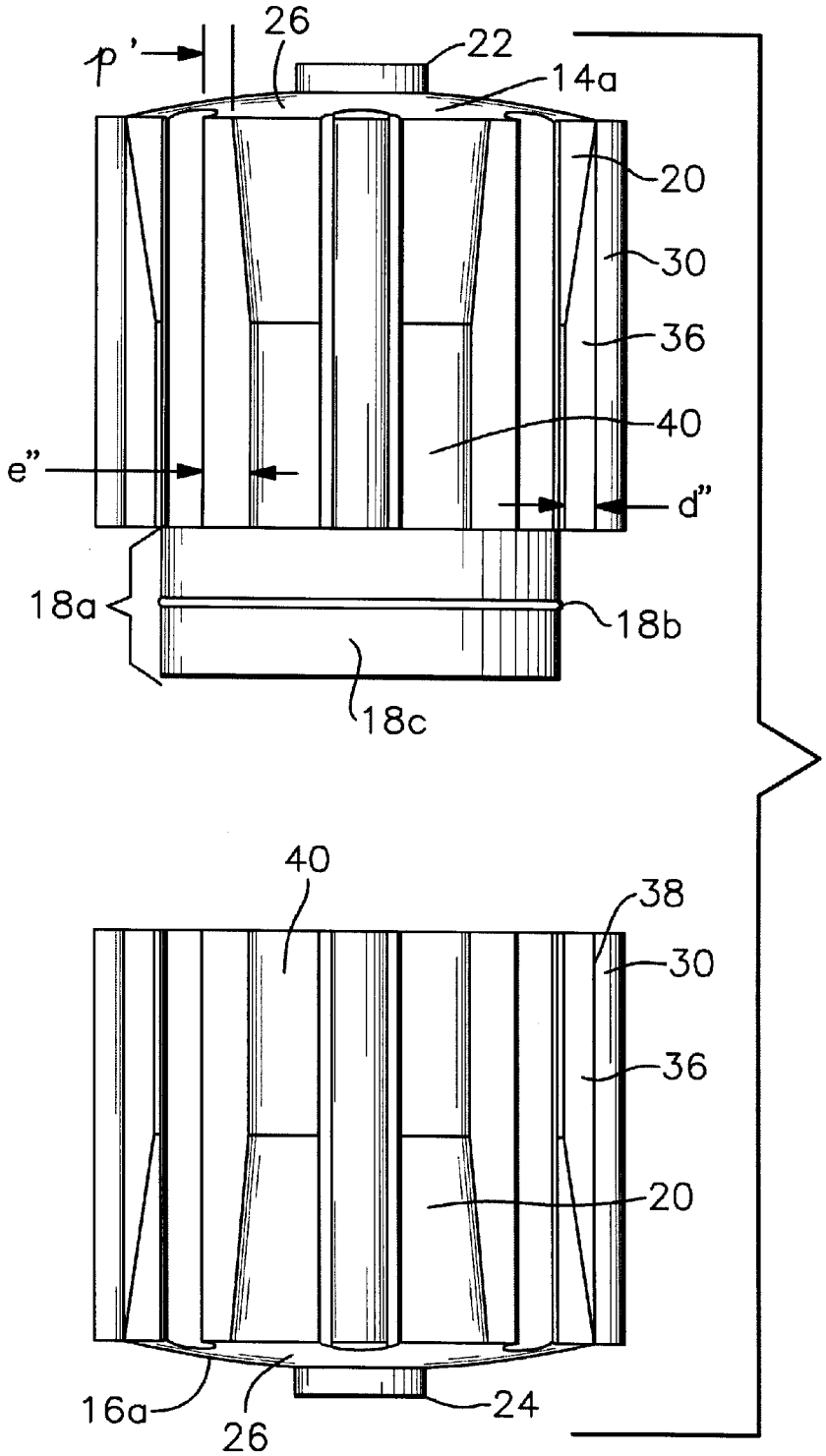
FIG. 4 is an elevational view of the present invention with the upper portion separated from the lower portion.

As further depicted in FIGS. 2–4, the connecting means includes a plurality of longitudinal cylinders 30 fixed to an inside surface 34 of corresponding arcuate-shaped longitudinal portions 32 and are spaced apart at a predetermined angle $\alpha$ along a periphery of each of the upper and lower portions 12*a*, 12*b*. The inside surface 34 of each arcuate-shaped longitudinal portion 32 commences at a predetermined depth within the cylindrical wall 42 of each of the upper and lower portions 12*a*, 12*b* or commences substantially tangent to the perimeter of the non-tapered external cylindrical wall surface 40. The arcuate-shaped longitudinal portions 32 further extend outwardly a predetermined distance d" beyond a non-tapered external surface 40 of the cylindrical wall 42 so as to form a vertical longitudinal peak 38 at opposing ends of the arcuate-shaped longitudinal portion 32, wherein each vertical peak 38 merges with a perimeter of the closed end 14*a*, 16*a* of each of the respective upper and lower portions 12*a*, 12*b*. The arcuate-shaped longitudinal portions 32 have a radial arc greater in diameter than a diameter of the longitudinal cylinders 30 so as to allow a clearance 44 between each longitudinal cylinder 30 and each opposing peak 38.

The connecting means further includes a plurality of coupler means. The coupler means are spaced-apart a predetermined angle α' along the periphery of each of the upper and lower portions 12*a*, 12*b*. Each coupler means further comprising a substantially C-shaped longitudinal portion 46, wherein an inside surface 52 of the C-shaped longitudinal portion 46 commences at a predetermined depth within the cylindrical wall 42 of each of the upper and lower portions 12*a*, 12*b* or commences substantially tangent to the perimeter of the non-tapered external cylindrical wall surface 40. The C-shaped longitudinal portion 46 further extends outwardly a predetermined distance e" beyond the non-tapered external surface 40 of the cylindrical wall 42 so as to form a vertical longitudinal peak 48 at opposing ends of the C-shaped longitudinal portion 46, wherein each vertical peak 48 extends a predetermined distance p' beyond the perimeter of the closed end 14*a*, 16*a* of each of the upper and lower portions 12*a*, 12*b*.

Each coupler means is capable of detachably engaging with a friction tight fit a corresponding longitudinal cylinder 30 on another toy capsule 10. The vertical peaks 48 of the C-shaped longitudinal portion 46 are adapted to extend into the clearances 44 between the longitudinal cylinder 30 and the arcuate-shaped vertical peaks 38, thereby facilitating the fairly tight frictional fit.

Each of the plurality of longitudinal cylinders 30 sequentially alternate along the periphery of each of the upper and lower portions 12*a*, 12*b* with each of the plurality of coupler means. In a practical application of the means for detachably connecting the respective open ends 14*b*, 16*b* of the upper and lower portions 12*a*, 12*b*, a lap joint 18 is formed which comprises a rim portion 18*a* which extends a predetermined width from one of the open ends 14*b*, 16*b*. The rim portion 18*a* has a circumferential bead 18*b* at an intermediate location around an outside surface 18*c* of the rim portion. The lap joint 18 also includes a recess 18*d* on an interior surface 18*e* of the remaining open end 14*b*, 16*b*, the recess 18*d* being located circumferentially a predetermined distance from an edge of the remaining open end 14*b*, 16*b*. The recess 18*d* is adapted to receive the bead 18*b* for interlocking the upper and lower portions 12*a*, 12*b* together.

Although the closed ends 14*a*, 16*a* may have flat surfaces, it is preferable that the external surface of the closed end 14*a*, 16*a* of each of the upper and lower portions 12*a*, 12*b* be domed-shaped 26 or slightly curved.

In a practical application of the rounded projection on one of the upper and lower portion closed ends 14*a*, 16*a*, it is preferable to include a concave portion 28 at a center of said rounded projection 22. This will facilitate a better fit for the rounded projection 22 into the recess area 18*d* should there be any imperfections or extrusions present from the manufacture of the toy capsule 10. It also allows an air pocket area for air expansion as the two portions 12*a*, 12*b* are joined end to end.

It is also preferable that at least one of the longitudinal cylinders 30 be hollow, depicted as hole 50. Practically, all of the longitudinal cylinders 30 will be hollow throughout for ease of manufacture thereby alleviating the needed to stock both solid and hollow cylinders 30. The hollow cylinders 30 will enable a string, wire or chain or similar attachment, not shown, to pass through the hole 50 for ease of carrying, displaying, hanging, etc.

Although any angular position may be used, in a practical application of the invention, it is preferable that each of the plurality of longitudinal cylinders 30 be spaced-apart at about 90° from each other, and each of the plurality of coupler means or C-shaped longitudinal portions 46 be spaced-apart at about 90° from each other. This resulting configuration will allow each of the plurality of longitudinal cylinders 30 to be spaced-apart from each of the plurality of coupler means at about 45°, depicted as angle θ, from each other.

The benefit for these connections along the perimeter of the cylinder walls 42 of the upper and lower portions 12*a*, 12*b* as well as the connections at the closed ends 14*a*, 16*a* of the upper and lower portions 12*a*, 12*b* is that the toy capsule 10 can be interconnected with similarly designed toy capsules 10 to form three-dimensional structures, as depicted in FIGS. 7–10.

The toy capsule 10 is preferably made from a durable and resilient plastic material. This type of material will allow a child to frequently handle the toy capsules 10, including frequently connecting and disconnecting the various portions or repetitively inserting and removing toy figurines and other toys from within the toy capsule 10.

As seen from the foregoing description, the present invention satisfies a need to provide a device which will facilitate the commercializing of a line of collectible toys where children can use the toy capsule as the base toy to create and erect structures consistent with the chosen theme and one's imagination, and where the toy capsule can be used to house surprise toys such as figurines to expand the theme concept.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A toy capsule for containing toys and for constructing structures comprising:

a generally hollow container including an upper portion and a lower portion;

the upper portion having an open end, a closed end and a cylindrical wall portion;

the lower portion having an open end, a closed end and a cylindrical wall portion;

the upper and lower portions having means for detachably connecting their respective open ends thereby defining a closed container when said open ends are connected;

a tapered thickened wall portion on each of the upper and lower portions, the tapered thickened wall portion extending concentrically from an intermediate location of an external surface of each of the cylindrical wall portions of the upper and lower portions and tapering to a thicker portion at the closed end of each of the upper and lower portions;

one of the upper and lower portion closed ends having a rounded projection and one of the remaining upper and lower closed ends having a projecting ridge defining a recess capable of receiving the rounded projection to form a releasable frictional tight fit connection;

connecting means on the external cylindrical wall surface of each of the upper and lower portions for connecting the toy capsule to one of an upper and lower portion, and of a combination thereof, of another toy capsule;

the connecting means including a plurality of longitudinal cylinders fixed to an inside surface of corresponding arcuate-shaped longitudinal portions and spaced apart at a predetermined angle along a periphery of each of the upper and lower portions, the arcuate-shaped longitudinal portions further extending outwardly a predetermined distance beyond a non-tapered external surface of the cylindrical wall so as to form a vertical longitudinal peak at opposing ends of the arcuate-shaped longitudinal portion wherein each vertical peak merges with a perimeter of the closed end of each of the upper and lower portions, the arcuate-shaped longitudinal portions having a radial arc greater in diameter than a diameter of the longitudinal cylinders so as to allow a clearance between the longitudinal cylinder and each peak;

the connecting means further including a plurality of coupler means, the coupler means being spaced-apart a predetermined angle along the periphery of each of the upper and lower portions, each coupler means further comprising a substantially C-shaped longitudinal portion, the C-shaped longitudinal portion further extending outwardly a predetermined distance beyond the non-tapered external surface of the cylindrical wall so as to form a vertical longitudinal peak at opposing ends of the C-shaped longitudinal portion wherein each vertical peak extends a predetermined distance beyond the perimeter of the closed end of each of the upper and lower portions, each coupler means being capable of detachably engaging with a friction tight fit a corresponding longitudinal cylinder on another toy capsule, wherein the vertical peaks of the C-shaped longitudinal portion are adapted to extend into the clearances between the longitudinal cylinder and the arcuate-shaped vertical peaks; and each of the plurality of longitudinal cylinders sequentially alternating along the periphery of each of the upper and lower portions with each of the plurality of coupler means.

2. The toy capsule according to claim 1, wherein the means for detachably connecting the respective open ends of the upper and lower portions comprises:

a lap joint wherein a rim portion extends a predetermined width from one of the open ends, the rim portion having a circumferential bead at an intermediate location around an outside surface of the rim portion; and a recess on an interior surface of the remaining open end, the recess being located circumferentially a predetermined distance from an edge of the remaining open end, wherein the recess is adapted to receive the bead for interlocking the upper and lower portions together.

3. The toy capsule according to claim 1, wherein the closed end of each of the upper and lower portions are domed-shaped.

4. The toy capsule according to claim 3, wherein the rounded projection on one of the upper and lower portion closed ends further includes a concave portion at a center of said rounded projection.

5. The toy capsule according to claim 1, wherein at least one of the longitudinal cylinders is hollow.

6. The toy capsule according to claim 1, wherein each of the plurality of longitudinal cylinders are spaced-apart at about 90° from each other.

7. The toy capsule according to claim 6, wherein each of the plurality of coupler means are spaced-apart at about 90° from each other.

8. The toy capsule according to claim 7, wherein each of the plurality of longitudinal cylinders are spaced-apart from each of the plurality of coupler means at about 45° from each other.

9. The toy capsule according to claim 1, wherein multiple toy capsules can be interconnected to form a three-dimensional structure.

10. The toy capsule according to claim 1, wherein the toy capsule is made from a durable and resilient plastic material.

11. A toy capsule for containing toys and for constructing structures comprising:

a generally hollow container including an upper portion and a lower portion;

the upper portion having an open end, a closed end and a wall portion;

the lower portion having an open end, a closed end and a wall portion;

the upper and lower portions having means for detachably connecting their respective open ends thereby defining a closed container when said open ends are connected;

a tapered thickened wall portion on each of the upper and lower portions, the tapered thickened wall portion extending concentrically from an intermediate location of an external surface of each of the wall portions of the upper and lower portions and tapering to a thicker portion at the closed end of each of the upper and lower portions;

one of the upper and lower portion closed ends having a rounded projection and one of the remaining upper and lower closed ends having a projecting ridge defining a recess capable of receiving the rounded projection to form a releasable frictional tight fit connection;

connecting means on the external wall surface of each of the upper and lower portions for connecting the toy capsule to one of an upper and lower portion, and of a combination thereof, of another toy capsule;

the connecting means including a plurality of longitudinal cylinders fixed to an inside surface of corresponding arcuate-shaped longitudinal portions and spaced apart at a predetermined angle along a periphery of each of the upper and lower portions, the arcuate-shaped longitudinal portions further extending outwardly a predetermined distance beyond a non-tapered external surface of the wall so as to form a vertical longitudinal peak at opposing ends of the arcuate-shaped longitudinal portion wherein each vertical peak merges with a perimeter of the closed end of each of the upper and lower portions, the arcuate-shaped longitudinal portions having a radial arc greater in diameter than a diameter of the longitudinal cylinders so as to allow a clearance between the longitudinal cylinder and each peak;

the connecting means further including a plurality of coupler means, the coupler means being spaced-apart a predetermined angle along the periphery of each of the upper and lower portions, each coupler means further comprising a substantially C-shaped longitudinal portion, the C-shaped longitudinal portion further extending outwardly a predetermined distance beyond the non-tapered external surface of the wall so as to form a vertical longitudinal peak at opposing ends of the C-shaped longitudinal portion wherein each vertical peak extends a predetermined distance beyond the perimeter of the closed end of each of the upper and lower portions, each coupler means being capable of detachably engaging with a friction tight fit a corresponding longitudinal cylinder on another toy capsule, wherein the vertical peaks of the C-shaped longitudinal portion are adapted to extend into the clearances between the longitudinal cylinder and the arcuate-shaped vertical peaks; and each of the plurality of longitudinal cylinders sequentially alternating along the periphery of each of the upper and lower portions with each of the plurality of coupler means.

12. The toy capsule according to claim 11, wherein the means for detachably connecting the respective open ends of the upper and lower portions comprises:

a lap joint wherein a rim portion extends a predetermined width from one of the open ends, the rim portion having a circumferential bead at an intermediate location around an outside surface of the rim portion; and a recess on an interior surface of the remaining open end, the recess being located circumferentially a predetermined distance from an edge of the remaining open end, wherein the recess is adapted to receive the bead for interlocking the upper and lower portions together.

13. The toy capsule according to claim 11, wherein the closed end of each of the upper and lower portions are domed-shaped.

14. The toy capsule according to claim 13, wherein the rounded projection on one of the upper and lower portion closed ends further includes a concave portion at a center of said rounded projection.

15. The toy capsule according to claim 11, wherein at least one of the longitudinal cylinders is hollow.

16. The toy capsule according to claim 11, wherein multiple toy capsules can be interconnected to form a three-dimensional structure.

17. The toy capsule according to claim 11, wherein the toy capsule is made from a durable and resilient plastic material.

* * * * *